US011245164B2

(12) United States Patent
Kasahara et al.

(10) Patent No.: US 11,245,164 B2
(45) Date of Patent: Feb. 8, 2022

(54) HIGH FREQUENCY WINDOW FORMED IN A CIRCULAR WAVEGUIDE THAT IS PLASTICALLY DEFORMABLE TO ADJUST A WAVEGUIDE LENGTH AND MANUFACTURING METHOD THEREFOR

(71) Applicant: NEC Network and Sensor Systems, Ltd., Tokyo (JP)

(72) Inventors: Akihiko Kasahara, Tokyo (JP); Takashi Nakano, Tokyo (JP)

(73) Assignee: NEC Network and Sensor Systems, Ltd., Tokyo (JP)

( * ) Notice: Subject to any disclaimer, the term of this patent is extended or adjusted under 35 U.S.C. 154(b) by 93 days.

(21) Appl. No.: 16/494,479

(22) PCT Filed: Mar. 23, 2018

(86) PCT No.: PCT/JP2018/011575
§ 371 (c)(1),
(2) Date: Sep. 16, 2019

(87) PCT Pub. No.: WO2018/174221
PCT Pub. Date: Sep. 27, 2018

(65) Prior Publication Data

US 2020/0020999 A1 Jan. 16, 2020

(30) Foreign Application Priority Data

Mar. 24, 2017 (JP) ..... JP2017-059345

(51) Int. Cl.
*H01P 1/08* (2006.01)

(52) U.S. Cl.
CPC ..... *H01P 1/08* (2013.01)

(58) Field of Classification Search
CPC ... H01P 1/08; H01P 5/082; H01J 23/18; H01J 23/20; H01J 23/36; H01J 23/40; H01J 23/48; H01J 23/54
(Continued)

(56) References Cited

U.S. PATENT DOCUMENTS 2,473,834 A * 6/1949 Tuller ..... H01P 1/08 333/256
2,773,289 A * 12/1956 Martin et al. ..... H01P 1/08 52/171.1
(Continued)

FOREIGN PATENT DOCUMENTS

CN 106463810 A 2/2017
JP 02-030608 U 2/1990
(Continued)

OTHER PUBLICATIONS

Extended European Search Report dated Dec. 10, 2020, issued by the European Patent Office in application No. 18772423.2.
(Continued)

*Primary Examiner* — Benny T Lee
(74) *Attorney, Agent, or Firm* — Sughrue Mion, PLLC

(57) ABSTRACT

An invention comprises: a circular waveguide that has a cylindrical section having a circular pipe conduit with a circular shaped cross section, and side wall sections joined to the both sides in an axial direction of the cylindrical section; a first rectangular waveguide that has a first rectangular pipe conduit with a rectangular shaped cross section and that is joined to one of the side wall sections so that the first rectangular pipe conduit communicates with the circular pipe conduit; a second rectangular waveguide that has a second rectangular pipe conduit with a rectangular shaped cross section and that is joined to the other of the side wall sections so that the second rectangular pipe conduit communicates with the circular pipe conduit; and a dielectric
(Continued)

plate that is configured as a plate shape, is disposed in the circular pipe conduit, and is airtightly held to the cylindrical section, wherein the circular waveguide has a plastically deformable section that is plastically deformable so that at least the length in an axial direction of the circular waveguide can be changed.

9 Claims, 12 Drawing Sheets

(58) Field of Classification Search
USPC ..... 333/252
See application file for complete search history.

(56) References Cited

U.S. PATENT DOCUMENTS

| | | | | |
|---|---|---|---|---|
| 2,869,086 | A * | 1/1959 | Curtis et al. | H01P 1/08 333/252 |
| 2,958,834 | A * | 11/1960 | Symons et al. | H01P 1/08 333/252 |
| 3,101,461 | A | 8/1963 | Henry-Bezy et al. | |
| 3,436,694 | A | 4/1969 | Walker | |
| 3,660,788 | A | 5/1972 | Alsberg | |
| 2007/0241845 | A1 | 10/2007 | Machida | |
| 2017/0077581 | A1 | 3/2017 | Nickel et al. | |

FOREIGN PATENT DOCUMENTS

| | | | |
|---|---|---|---|
| JP | 11-177301 | A | 7/1999 |
| JP | 2007-287382 | A | 11/2007 |

OTHER PUBLICATIONS

International Search Report for PCT/JP2018/011575 dated Jun. 19, 2018 [PCT/ISA/210].
Chinese Office Action for CN Application No. 201880020463.0 dated Feb. 24, 2021 with English Translation.

* cited by examiner

HIGH FREQUENCY WINDOW FORMED IN A CIRCULAR WAVEGUIDE THAT IS PLASTICALLY DEFORMABLE TO ADJUST A WAVEGUIDE LENGTH AND MANUFACTURING METHOD THEREFOR

DESCRIPTION OF RELATED APPLICATION

The present application is National Stage of International Application No. PCT/JP2018/011575 filed Mar. 23, 2018, based on a claim to priority of Japanese Patent Application No. 2017-059345 (filed on Mar. 24, 2017), the entire contents of the application shall be incorporated and stated in the present document by reference thereto.

FIELD

The present invention relates to a high frequency window and a manufacturing method therefor.

BACKGROUND

A high frequency window is provided at an input/output section for a signal (electromagnetic wave) of a microwave tube such as a travelling wave tube or a klystron. The high frequency window is used to perform input and output of an electromagnetic wave while keeping an inside of the high frequency window airtight (for example, a vacuum) of the microwave tube (for example, an atmospheric pressure or gas-filled outside). As a high frequency window, there is a coaxial type high frequency window and a pillbox type high frequency window mainly.

The pillbox type high frequency window generally has an arrangement in the order of: a rectangular waveguide (square waveguide), circular waveguide (cylindrical waveguide), a disk shaped dielectric (circular dielectric), a circular waveguide, and a rectangular waveguide (for example, see Patent Literature 1). The circular dielectric is inserted between two circular waveguides via a metalization layer from both sides in the axial direction of the circular dielectric, or is supported by an inner peripheral face of the circular waveguide via a metalization layer at an outer peripheral face of the circular dielectric. Thus, the airtightness of a joined portion of the circular dielectric and the circular waveguide is preserved. The pillbox type high frequency window has a configuration in which multiple stages of different impedances are joined, and since a band width (range) is provided by multiple reflections, a desired band width (resonance frequency, S11) is obtained by adjusting dimensions and permittivity of respective components.

[PTL 1]

Japanese Patent Kokai Publication No. JP2007-287382A, published Nov. 1, 2007

[PTL 2]

Japanese Patent Kokai Publication No. JP-H02-30608U, published Feb. 27, 1990

The following analysis is given by the inventors of the present invention.

Since the band width (resonance frequency, S11) of a pillbox type high frequency window is determined by dimensions and permittivity of respective components, a discrepancy from a design value (design value of the band width) occurs easily due to variations or the like in component dimensional accuracy, assembly accuracy or permittivity. Also, since the band width of a pillbox type high frequency window becomes wider when a component dimension is approximately a wavelength (when component dimension is small), the component dimension becomes small at high frequency with short wavelength. Accordingly, at high frequency, even for a small discrepancy in a component dimension, the discrepancy from the design value becomes large.

In order to respond flexibly to discrepancy from the design value, it is desirable to enable a correction so as to obtain the desired design value. In order to enable a correction so as to obtain the desired design value, using a flexible waveguide as disclosed in Patent Literature 2 may be considered, instead of a circular waveguide of the pillbox type high frequency window. The flexible waveguide described in Patent Literature 2 has a structure in which external force is not applied to the waveguide itself, by further covering the outer periphery of the flexible waveguide with a flexible vacuum bellows, and the original form is preserved when the inside of the waveguide is made a vacuum. However, by only applying a waveguide of a bellows structure as in Patent Literature 2 to a circular waveguide of the pillbox type high frequency window, a desired band width is not obtained.

A main object of the present invention is to provide a high frequency window and a manufacturing method therefor, in which it is possible to maintain the desired design value, even if a discrepancy from a design value occurs by variations or the like in component dimensional accuracy, assembly accuracy or permittivity.

A high frequency window according to a first aspect comprises: a circular waveguide that has a cylindrical section having a circular pipe conduit with a circular shaped cross section, and end wall sections joined to both ends of the cylindrical section in an axial direction; a first rectangular waveguide that has a first rectangular pipe conduit with a rectangular shaped cross section and that is joined to one of the end wall sections so that the first rectangular pipe conduit communicates with the circular pipe conduit; a second rectangular waveguide that has a second rectangular pipe conduit with a rectangular shaped cross section and that is joined to the other of the end wall sections so that the second rectangular pipe conduit communicates with the circular pipe conduit; and a dielectric plate that is configured as a plate shape, is disposed in the circular pipe conduit, and is airtightly held to the cylindrical section, wherein the circular waveguide has a plastically deformable section such that a length in an axial direction of the circular waveguide can be changed.

A manufacturing method for a high frequency window according to a second aspect, wherein a circular waveguide is joined between a first rectangular waveguide and a second rectangular waveguide, and a dielectric plate in the circular waveguide separates a space on the first rectangular waveguide side and a space on the second rectangular waveguide side, the high frequency window having a plastically deformable section that allows plastic deformation in at least an axial direction of the circular waveguide in the circular waveguide, the method including: adjusting the length in an axial direction of the circular waveguide, such that, with the space on the first rectangular waveguide side and the space on the second rectangular waveguide side each having prescribed pressures, the value of S11 is minimum when an electromagnetic wave of a prescribed frequency is transmitted to the first rectangular waveguide from the second rectangular waveguide, wherein the plastically deformable section is plastically deformed when the length in the axial direction of the circular waveguide is adjusted.

According to the first aspect, it is possible to maintain the desired design value even if a discrepancy from a design value occurs by variations or the like in component dimensional accuracy, assembly accuracy or permittivity.

PREFERRED MODES FOR CARRYING OUT THE INVENTION

Figure 1:
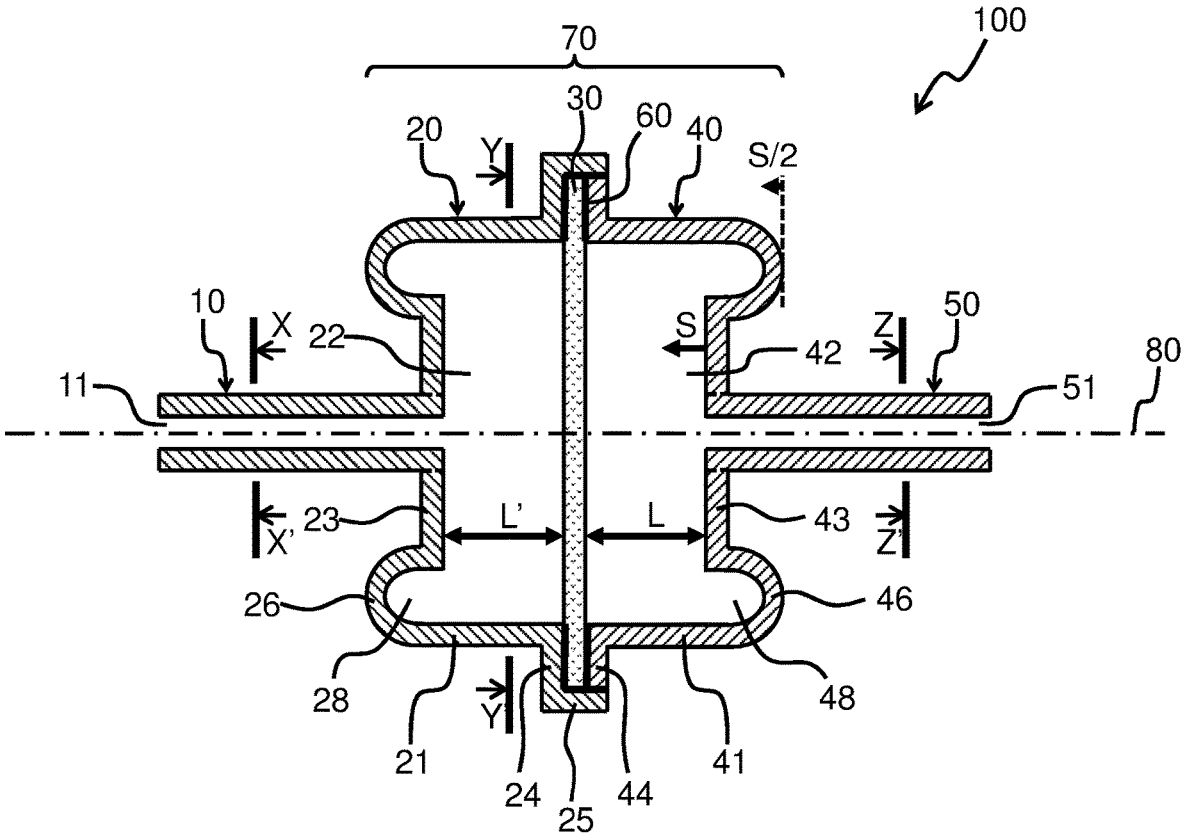
FIG. 1 is a cross section along an axial direction schematically showing a configuration of a high frequency window according to a first example embodiment.

Hereinafter, exemplary embodiments will be explained with reference to the drawings where like features are denoted by the same reference numerals throughout the drawings. When reference numerals to the drawings are attached in the present application, they are exclusively intended to aid understanding and are not intended to be limited to the illustrated mode(s). The following embodiments are merely examples, and they are not intended to limit the present invention.

First Example Embodiment

Figure 2A:
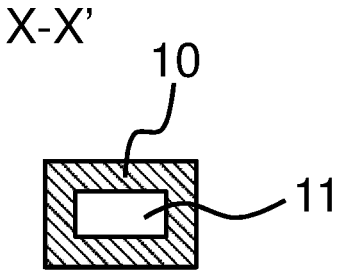
FIG. 2A is a cross section across X-X' of FIG. 1.
Figure 2B:
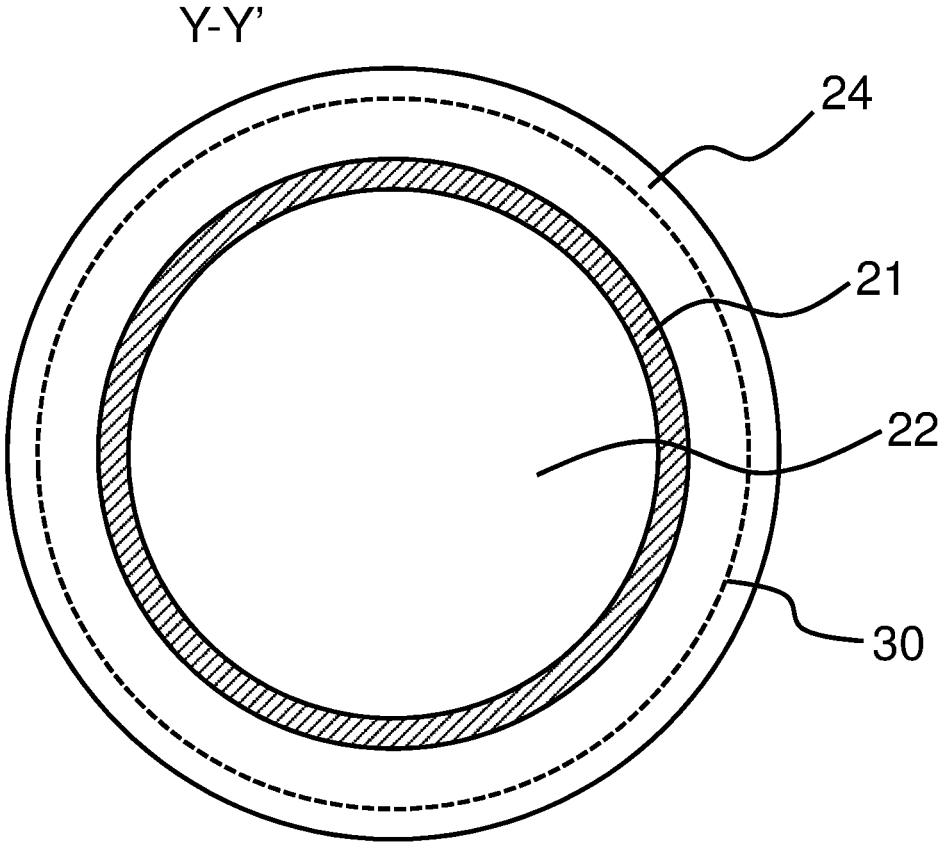
FIG. 2B is a cross section across Y-Y' of FIG. 1.
Figure 2C:
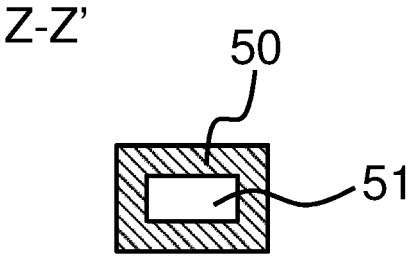
FIG. 2C is a cross section across Z-Z' of FIG. 1, schematically showing a configuration of the high frequency window according to the first example embodiment.

A high frequency window according to a first example embodiment will be explained with reference to the drawings. FIG. 1 is a cross section along an axial direction schematically showing a configuration of the high frequency window according to first example embodiment. FIG. 2A is a cross section across X-X' of FIG. 1, FIG. 2B is a cross section across Y-Y' of FIG. 1, and FIG. 2C is a cross section across Z-Z' of FIG. 1, schematically showing a configuration of the high frequency window according to the first example embodiment.

As shown in FIG. 1, the high frequency window 100 is an apparatus for performing input and output of a signal (an electromagnetic wave) while maintaining airtightness of the inside (for example, a vacuum) of a microwave tube to the outside (for example, an atmospheric pressure or gas-filled environment). The high frequency window 100 is also referred to as an RF (Radio Frequency) window and a pillbox type high frequency window. The high frequency window 100 is provided at an input output section of a vacuum tube apparatus. The high frequency window 100 has a configuration in which a first rectangular waveguide 10, a first circular waveguide 20, a dielectric plate 30, a second circular waveguide 40, and a second rectangular waveguide 50 are joined in that order in the direction of a central axis 80. The high frequency window 100 comprises a circular waveguide 70 (the first circular waveguide 20, the second circular waveguide 40), a first rectangular waveguide 10, a second rectangular waveguide 50, and a dielectric plate 30.

The circular waveguide 70 is a tubular member having a cylindrical section (a first cylindrical section 21, a second cylindrical section 41), and a side wall section(s) (a first side wall section 23, a second side wall section 43). The circular waveguide 70 is arranged between the first rectangular waveguide 10 and the second rectangular waveguide 50. The circular waveguide 70 is configured as an assembly of the first circular waveguide 20 and the second circular waveguide 40.

The first circular waveguide 20 is a tubular member having a first cylindrical section 21 and a first side wall section 23.

The first cylindrical section 21 is a tubular portion having a first circular pipe conduit 22 with an inner side cross section of a circular shape. The first circular pipe conduit 22 is a space having an outer periphery that is surrounded by the first cylindrical section 21, and is a pipe conduit with a cross section of a circular shape. The first cylindrical section 21 has a first flange section 24 extending outwards in a radial direction from the first cylindrical section 21 to an edge section on the side of the second cylindrical section 41. The first flange section 24 is in connection with a dielectric plate 30 via a joining section 60. The first cylindrical section 21 has a mounting section 25 protruding from an external peripheral edge section of the first flange section 24 to the second cylindrical section 41 side ranging over the entire periphery. The mounting section 25 is mountable to the external peripheral face of the second flange section 44 of the second cylindrical section 41. The mounting section 25 regulates movement in a radial direction of the dielectric plate 30. The mounting section 25 is in connection with the second flange section 44 and the dielectric plate 30 via the joining section 60.

The first side wall section 23 is joined to the first cylindrical section 21 so as to block an outer side (side of the first rectangular waveguide 10) in an axial direction (direction along the central axis 80) of the first cylindrical section 21. The first side wall section 23 has a first diaphragm 26.

The first diaphragm 26 is a plastically deformable section allowing a plastic deformation such that the length (length L' in an axial direction of the first circular pipe conduit 22) in an axial direction (direction along the central axis 80) of the first circular waveguide 20) is changed. The first diaphragm 26 protrudes to the outer side (side of the first rectangular waveguide 10) in an axial direction of the first circular waveguide 20 ranging over the entire periphery in at least part of the first side wall section 23. The first diaphragm 26 is configured so as to maintain the length in the axial direction of the first circular waveguide 20, even if a pressure difference between the inside and the outside of the first circular waveguide 20 occurs. The inside space surrounded by the first diaphragm 26 forms a first ring shaped protruding section 28. The first ring shaped protruding section 28 is in connection with the first circular pipe conduit 22. The first diaphragm 26 is preferably disposed in the vicinity (a position near the outer periphery) of a joining portion of the first side wall section 23 and the first cylindrical section 21 in the first side wall section 23. Note that the first diaphragm 26 is not limited to a position near the outer periphery. In order to allow plastic deformation, the first diaphragm 26 is preferably configured such that the thickness of the first diaphragm 26 is thinner than the thickness of a portion excluding the first diaphragm 26 in the first circular waveguide 20.

The second circular waveguide 40 is a tubular member having the second cylindrical section 41 and the second side wall section 43.

A second cylindrical section 41 is a tubular section having a second circular pipe conduit 42 with a circular shaped cross section on an inner side. The second circular pipe conduit 42 is a space having an outer periphery that is surrounded by the second cylindrical section 41, and is a pipe conduit with a circular shaped cross section. The second cylindrical section 41 has a second flange section 44 extending outwards in a radial direction of the second cylindrical section 41 from an edge section on the second cylindrical section 41 side. The second flange section 44 is mountable to the inside of the mounting section 25 at an outer peripheral face. The second flange section 44 is in connection with the mounting section 25 and the dielectric plate 30 via a joining section 60.

The second side wall section 43 is joined to the second cylindrical section 41 to block an outer side (side of the second rectangular waveguide 50) in an axial direction (direction along the central axis 80) of the second cylindrical section 41. The second side wall section 43 has a second diaphragm 46.

The second diaphragm 46 is a plastically deformable section allowing a plastic deformation such that the length (length L in an axial direction of the second circular pipe conduit 42) in an axial direction (direction along a central axis 80) of the second circular waveguide 40) is changed. The second diaphragm 46 protrudes to the outer side (the second rectangular waveguide 50 side) in the axial direction of the second circular waveguide 40 ranging over the entire periphery in at least part of the second side wall section 43. The second diaphragm 46 is configured so as to maintain the length in the axial direction of the second circular waveguide 40, even if a pressure difference between the inside and the outside of the second circular waveguide 40 occurs. The inside space surrounded by the second diaphragm 46 is a second ring shaped protruding section 48. The second ring shaped protruding section 48 is in connection with the second circular pipe conduit 42. The second diaphragm 46 is preferably disposed in the vicinity (a position near the outer periphery) of a joining portion of the second side wall section 43 and the second cylindrical section 41 in the second side wall section 43. Note that the second diaphragm 46 is not limited to a position near the outer periphery. In order to allow plastic deformation, the second diaphragm 46 is preferably configured such that the thickness of the second diaphragm 46 is thinner than the thickness of a portion excluding the second diaphragm 46 in the first circular waveguide 20. If the inner wall face of the second side wall section 43 is moved by a shift amount of S in an axial direction, the second diaphragm 46 can be set to that an apex in an axial direction of the outer face of the second diaphragm 46 moves by S/2. This point also applies for the first diaphragm 26.

It is to be noted that in the high frequency window 100 according to the first example embodiment, although the first diaphragm 26 and the second diaphragm 46 are provided, only one of either the first diaphragm 26 and the second diaphragm 46 may also be provided.

The first rectangular waveguide 10 is a tubular member having the first rectangular pipe conduit 11 with a cross section of a rectangular shape as shown in FIG. 2A. The first rectangular waveguide 10 is joined to a first side wall section 23 such that the first rectangular pipe conduit 11 is connected to the first circular pipe conduit 22. The first rectangular waveguide 10 may be configured integrally with the first circular waveguide 20.

The second rectangular waveguide 50 is a tubular member having the second rectangular pipe conduit 51 with a cross section of a rectangular shape as shown in FIG. 2C. The second rectangular waveguide 50 is joined to a second side wall section 43 such that the second rectangular pipe conduit 51 is connected to the second circular pipe conduit 42. The second rectangular waveguide 50 may be configured integrally with the second circular waveguide 40.

The material of the first circular waveguide 20, the second circular waveguide 40, the first rectangular waveguide 10, and the second rectangular waveguide 50 may use, for example, a metal such as copper or nickel, a copper alloy such as gunmetal, brass, phosphor bronze, aluminum bronze, nickel silver or nickel copper, or a nickel alloy such as FeNiCo alloy, Kovar (trademark of CRS Holdings, inc., Delaware), Monel (trademark of Special Metals Corporation, New York), Hastelloy (trademark of Haynes International, Indiana), Nichrome, Inconel (trademark of Special Metals Corporation, New York), Permalloy, Constanan, Jura Nickel, Alumel (trademark of Concept Alloys, Inc., Michigan), Chromel (trademark of Concept Alloys, Inc., Michigan), Invar (64FeNi), or Elinvar (FeNiCr).

The dimensions of the rectangular waveguides 10 and 50 are set in accordance with frequency band width to be used, according to EIAJ (Electronic Industries Association of Japan) standard. For example, in a case where the frequency of an electromagnetic wave is 0.3 THz, the dimensions of the rectangular waveguides 10 and 50 are according to inner diameter nominal dimension 0.864 mm×0.432 mm of EIAJ type name WRI-2600 of EIAJ standard TT-3006 applied to frequency band width 217-330 GHz. It is to be noted that since the dimensions of the circular waveguides 20 and 40 are an adjustment target, the dimensions are not standardized. Wall thickness of the circular waveguides 20 and 40 and the rectangular waveguides 10 and 50 may be less than 0.1 mm.

The dielectric plate 30 is a member formed of a dielectric configured in a circular plate shape as shown in FIG. 2B. The dielectric plate 30 has a role of separating the pressure (for example, a vacuum) of the first circular pipe conduit 22 and the pressure (for example, atmospheric pressure) of the second circular pipe conduit 42. The dielectric plate 30 also has a role of preventing multiple reflections of an electromagnetic wave. In addition, the dielectric plate 30 also has a role of selectively passing an electromagnetic wave of a prescribed frequency. The dielectric plate 30 is airtightly held to the first cylindrical section 21 and the second cylindrical section 41 by being sandwiched between the first flange section 24 and the second flange section 44 from both sides in an axial direction of the dielectric plate 30. The dielectric plate 30 is in connection with the first flange section 24, the second flange section 44 and the mounting section 25, via a joining section 60. For material of the dielectric plate 30, for example, sapphire or quartz may be used, and preferably a dielectric material with a thermal expansion coefficient close to the thermal expansion coefficient of a material is used in the waveguides 10, 20, 40 and 50. It is to be noted that since the dimension of the dielectric plate 30 is an adjustment target, they are not standardized.

The joining section 60 is a section interposed at a joining face between the first flange section 24 and the dielectric plate 30, a joining face between the mounting section 25 and the dielectric plate 30, a joining face between the second flange section 44 and the dielectric plate 30, and a joining face between the mounting section 25 and the second flange section 44. The joining section 60 tightly couples the respective joining faces. The joining section 60 may be, for example, a metalized area, a welded area, a brazed area (for example, brazing material with a melting point of 800-1000° C.) or the like. The joining sections 60 of each the joining faces may be joining sections 60 of all the same method, or may be joining sections 60 of each different methods.

The high frequency window 100 as described above, besides forming diaphragms 26 and 46 in the circular waveguides 20 and 40, may be assembled by a conventional method. Thereafter, pressures in a space (first rectangular pipe conduit 11, first circular pipe conduit 22; for example, a vacuum) on the first rectangular waveguide 10 and a space (second rectangular pipe conduit 51, second circular pipe conduit 42; for example, atmospheric pressure) on the second rectangular waveguide 50, are set to prescribed pressures respectively, and an electromagnetic wave of a prescribed frequency is transmitted from the second rectangular waveguide 50 to the first rectangular waveguide 10, a test is made as to whether or not a resonance frequency according to design value is obtained. In a case where the resonance frequency according to design value is not obtained, due to variations or the like in component dimensional accuracy, assembly accuracy or permittivity, the lengths (lengths L, L' in an axial direction of the circular pipe conduits 22 and 42) in the axial direction (direction along central axis 80) of the circular waveguides 20 and 40, are adjusted so that the resonance frequency is minimized. When length in an axial direction of the circular waveguides 20 and 40 is adjusted, the diaphragms 26, 46 are plastically deformed.

According to the first example embodiment, by providing the diaphragms 26 and 46 in the circular waveguides 20 and 40, even if a discrepancy from a design value occurs due to variations or the like in component dimensional accuracy, assembly accuracy or permittivity, since it is possible to adjust the length in an axial direction of the circular waveguides 20 and 40 by plastically deforming the diaphragms 26 and 46, it is possible to correct the discrepancy from the design value even after assembly, and a high frequency window 100 with optimal characteristics is obtained. Also, after the high frequency window 100 is incorporated to a microwave tube, it is possible to adjust band width even while maintaining vacuum airtightness. Therefore, according to first example embodiment, even if variations or the like in component dimensional accuracy, assembly accuracy or permittivity occur, since it is possible to obtain a desired band width by adjusting the diaphragms 26 and 46, there is no need for re-manufacturing the high frequency window 100, and this leads to a decrease in cost. Further, according to the first example embodiment, since the diaphragms 26 and 46 are configured so as to maintain the length in the axial direction of the circular waveguides 20 and 40, even if pressure difference between inside and outside of the circular waveguides 20 and 40 occurs, it is possible to minimize negative effects.

Examples 1 and 2

Figure 3A:
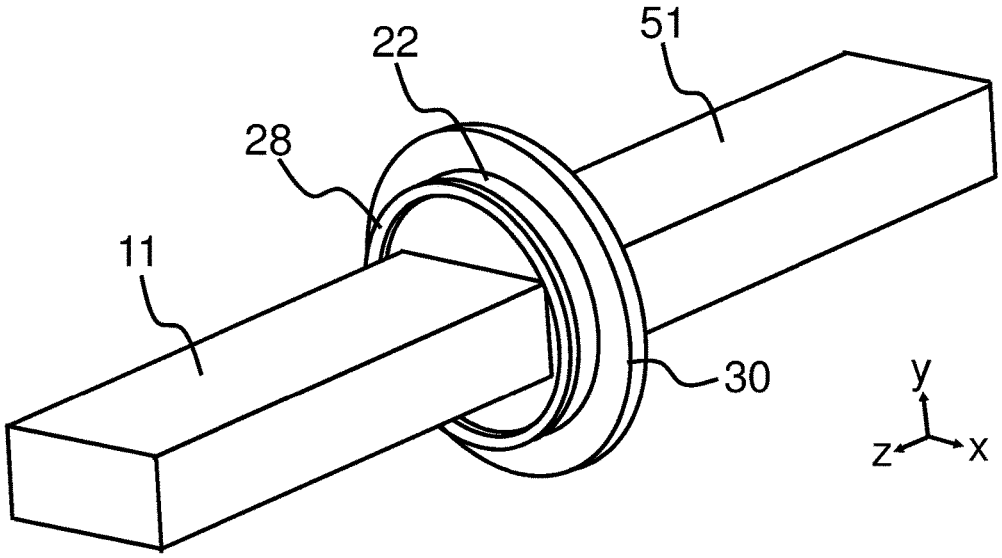
FIG. 3A is a perspective view schematically showing a configuration for an electromagnetic field analysis.
Figure 3B:
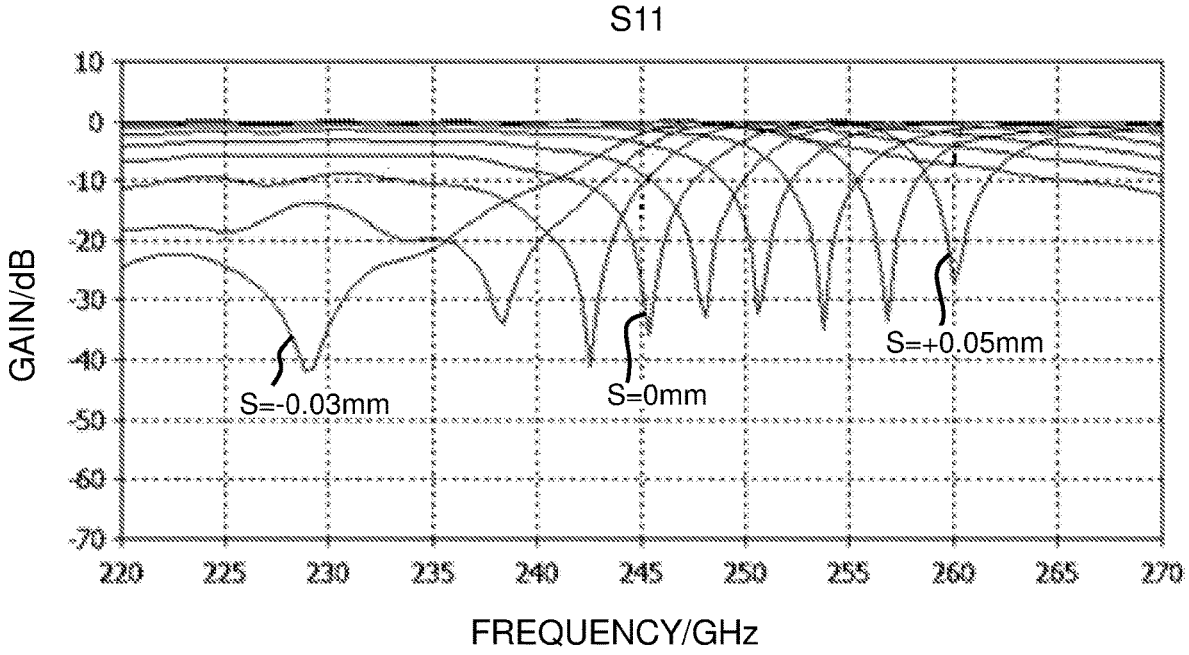
FIG. 3B is a graph showing relationships between gain value of S11 and shift amount S and frequency, of a high frequency window according to example 1.
Figure 4A:
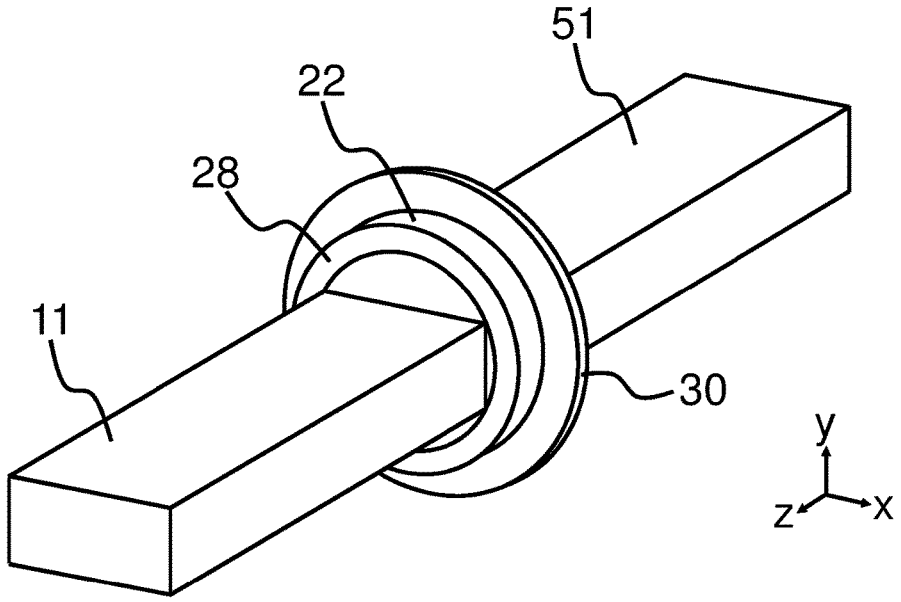
FIG. 4A is a perspective view schematically showing a configuration for an electromagnetic field analysis.
Figure 4B:
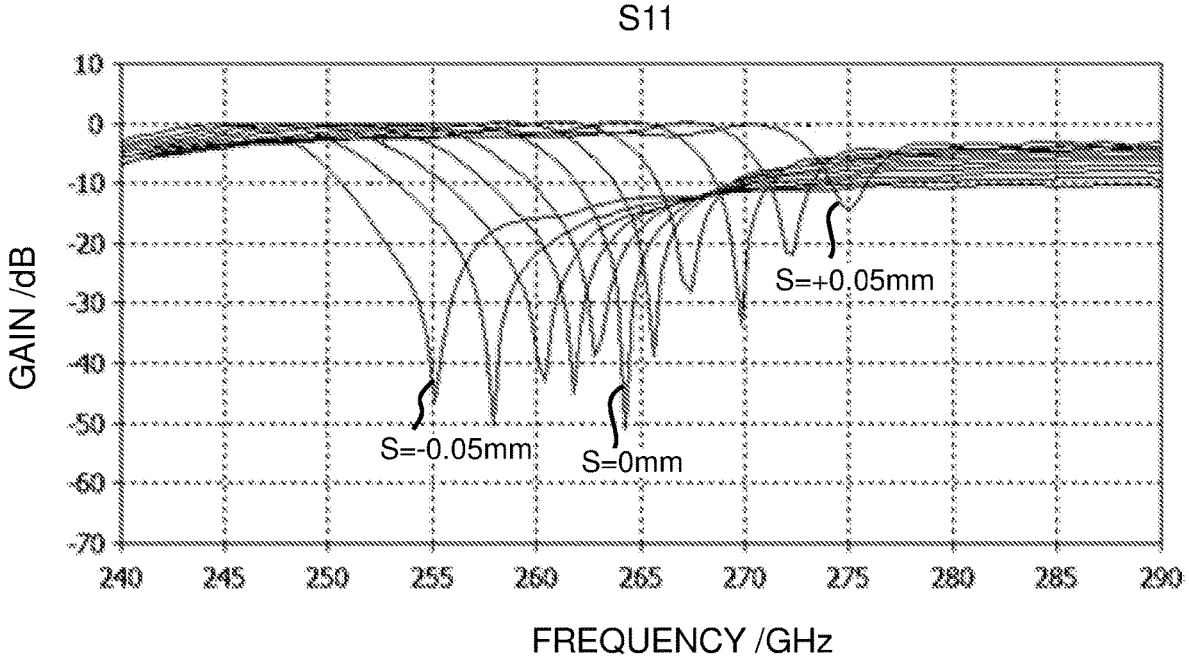
FIG. 4B is a graph showing relationships between gain value of S11 and shift amount S and frequency, of a high frequency window according to example 2.

A 3-dimensional electromagnetic field analysis of a high frequency window according to examples 1 and 2 will be explained with reference to the drawings. FIG. 3A including coordinate axes (x, y, z) is a perspective view schematically showing a configuration for use in performing an electromagnetic field analysis, and FIG. 3B is a graph showing relationships between gain value of S11 and shift amount S and frequency, of a high frequency window according to example 1. FIG. 4A is a perspective view schematically showing a configuration for use in performing an electromagnetic field analysis, and FIG. 4B is a graph showing relationships between S11 and shift amount S and frequency of a high frequency window according to example 2.

Although the basic configuration of the high frequency window according to examples 1 and 2 is similar to the basic configuration of the high frequency window according to the first example embodiment (see FIG. 1 and FIGS. 2A-2C), the size (dimensions) of the first ring shaped protruding section 28 (FIGS. 3A and 4A) and the second ring shaped protruding section (equivalent to 48 in FIG. 1; in the shadow of the dielectric plate 30) differ, and the dimensions of other component sections (the first rectangular pipe conduit 11, the first circular pipe conduit 22, the dielectric plate 30, the second circular pipe conduit (equivalent to 42 in FIG. 1) in the shadow of the dielectric plate 30, and the second rectangular pipe conduit 51) are the same as shown in FIGS. 3A and 4A. It is to be noted that in FIG. 3A and FIG. 4A, wall faces (for example, metal such as Cu) of the waveguides (equivalent to 10, 20, 40 and 50 in FIG. 1) are omitted.

With regard to the dimensions of the respective component sections, resonance frequency is set to be approximately 250 GHz. That is, the cross section dimensions of the first rectangular pipe conduit 11 are set to vertical dimension of 0.432 mm×horizontal dimension of 0.864 mm, the dimensions of the first circular pipe conduit 22 are set to diameter of 1.3 mm×thickness 0.2 mm to 0.3 mm (medium value 0.25 mm), the dimensions of the dielectric plate 30 are set to diameter of 2 mm×thickness dimension of 0.1 mm, the dimensions of the second circular pipe conduit (equivalent to 42 of FIG. 1) are set to diameter of 1.3 mm×thickness dimension of 0.2 mm to 0.3 mm (median value 0.25 mm), and the cross section dimensions of the second rectangular pipe conduit 51 are set to vertical dimension of 0.432 mm×horizontal dimension of 0.864 mm. The dimensions of the first ring shaped protruding section 28 and the second ring shaped protruding section (equivalent to 48 of FIG. 1) in FIG. 3A are set to external diameter of 1.3 mm, internal diameter of 1.25 mm, and cross section diameter of 0.05 mm. The dimensions of the first ring shaped protruding section 28 and the second ring shaped protruding section (equivalent to 48 of FIG. 1) in FIG. 4A are set to external diameter of 1.3 mm, internal diameter of 1.2 mm, and protrusion amount in Z direction of 0.1 mm (double the cross section diameter of the first ring shaped protruding section 28 and the second ring shaped protruding section (equivalent to 48 of FIG. 1) of FIG. 3A).

MICROWAVE-STUDIO manufactured by CST Company was used for 3-dimension electromagnetic field analysis of a high frequency window. A 3-dimension electromagnetic field analysis result of a high frequency window according to example 1 is as in FIG. 3B, and a 3-dimension electromagnetic field analysis result of a high frequency window according to example 2 is as in FIG. 4B. In FIG. 3B and FIG. 4B, the horizontal axis indicates frequency GHz and the vertical axis indicates gain value of S11 (return loss in dB). It is to be noted that in the first ring shaped protruding section 28 and the second ring shaped protruding section (equivalent to 48 of FIG. 1), similar to FIG. 1, calculation is performed assuming that when the length (equivalent to L, L' in FIG. 1) in the axial direction of the first circular pipe conduit 22 and the second circular pipe conduit (equivalent to 42 in FIG. 1) is changed by a shift amount S in an axial direction, apexes of the first ring shaped protruding section 28 and the second ring shaped protruding section (equivalent to 48 of FIG. 1) will be changed by S/2 in an axial direction. It is to be noted that the shift amount S is changed by changing both the first circular pipe conduit and the second circular pipe conduit.

Referring to FIG. 3B, resonance frequency (frequency of a portion where gain is minimum in the graph) changes as the shift amount S changes in example 1. Although the change is not large with regard to S11, it is possible to select an optimum value by combining with resonance frequency. FIG. 3B shows, e.g., shift amounts S=−0.03 mm, S=0 mm, and S=+0.05 mm.

Referring to FIG. 4B, it is understood that resonance frequency changes as the shift amount S changes in example 2. Although the change is not large with regard to S11, it is possible to select an optimum value based on the resonance frequency. Also, in example 2, although cross section diameters of the first ring shaped protruding section 28 and the second ring shaped protruding section (equivalent to 48 of FIG. 1) of example 1 are doubled, a large difference in the resonance frequency trend does not occur, and it is understood that the discrepancy (or variation) in design value according to size of the first ring shaped protruding section 28 and the second ring shaped protruding section (equivalent to 48 of FIG. 1) is small, and design of the first ring shaped protruding section 28 and the second ring shaped protruding section (equivalent to 48 of FIG. 1) need not be rigorous. This point may be said to be a merit of the configuration of the first example embodiment. FIG. 4B shows, e.g., shift amounts S=−0.05 mm, S=0 mm, and S=+0.05 mm.

Second Example Embodiment

Figure 5:
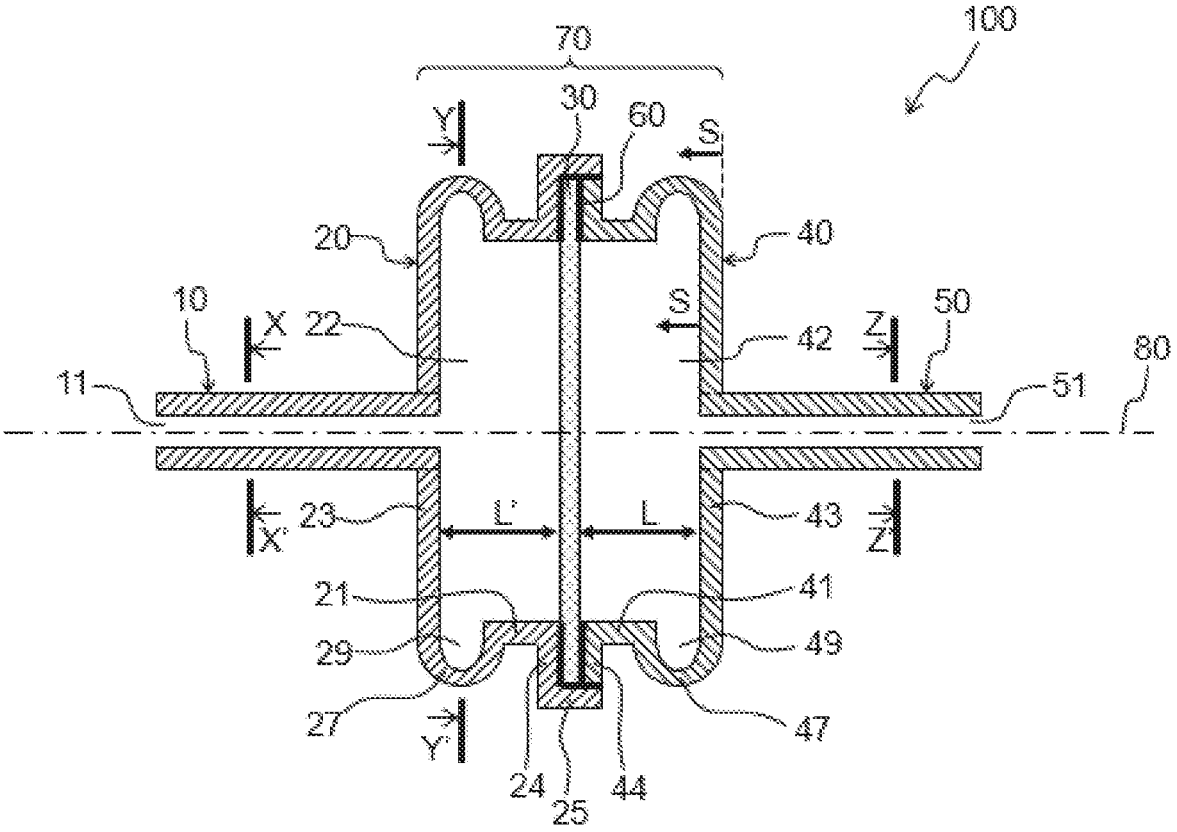
FIG. 5 is a cross section along an axial direction schematically showing a configuration of a high frequency window according to a second example embodiment.
Figure 6A:
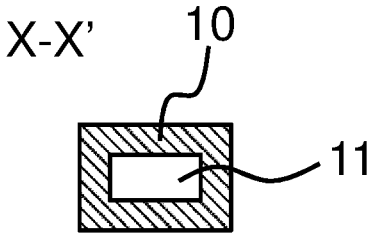
FIG. 6A is a cross section across X-X' of FIG. 5.
Figure 6B:
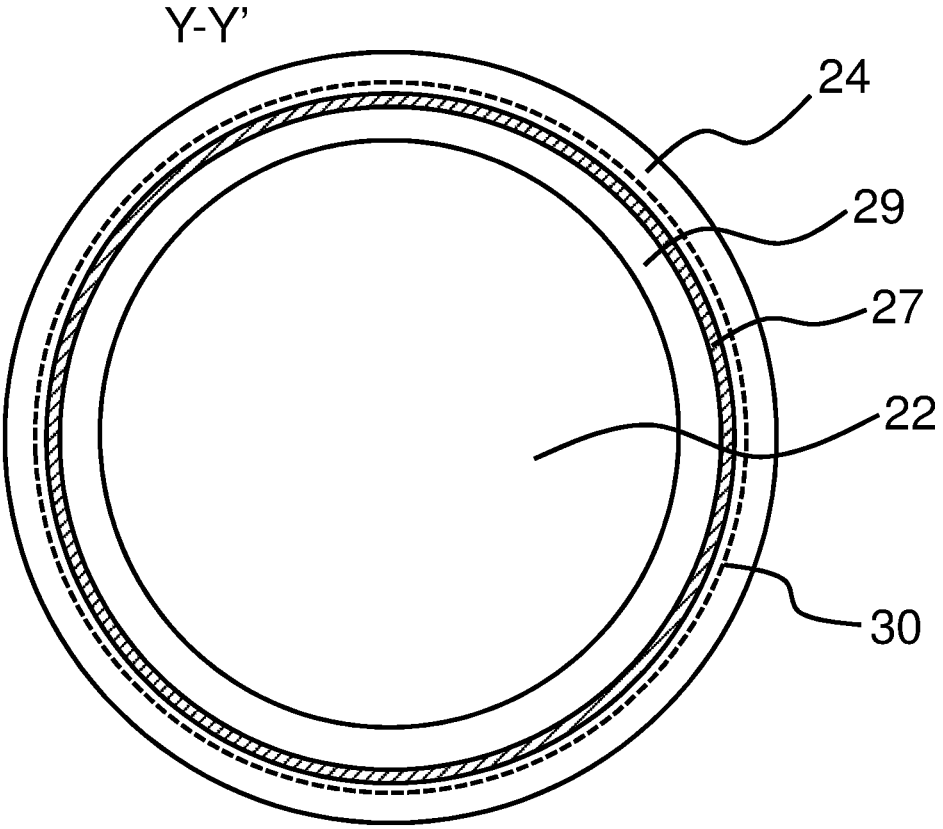
FIG. 6B is a cross section across Y-Y' of FIG. 5.
Figure 6C:
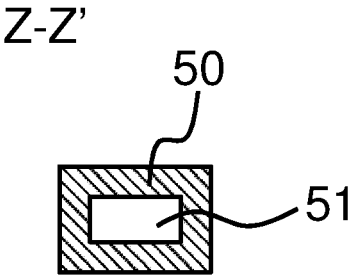
FIG. 6C is a cross section across Z-Z' of FIG. 5, schematically showing a configuration of the high frequency window according to the second example embodiment.

A high frequency window according to a second example embodiment will be explained with reference to the drawings. FIG. 5 is a cross section along an axial direction schematically showing a configuration of the high frequency window according to the second example embodiment. FIG. 6A is a cross section across X-X' of FIG. 5, FIG. 6B is a cross section across Y-Y' of FIG. 5, and FIG. 6C is a cross section across Z-Z' of FIG. 5, schematically showing a configuration of the high frequency window according to the second example embodiment.

In the second example embodiment, being a modified example of the first example embodiment, diaphragms 27 and 47 are not provided to the end wall sections 23 and 43, but to the cylindrical section 21.

The first diaphragm 27 is a plastically deformable section allowing a plastic deformation such that the length (length L' in an axial direction of the first circular pipe conduit 22) in an axial direction (direction along the central axis 80) of the first circular waveguide 20 is changed. The first diaphragm 27 protrudes to the outer side in a radial direction of the first circular waveguide 20, the first diaphragm being disposed at a periphery of the first cylindrical section 21. The first diaphragm 27 is configured so as to maintain the length in the axial direction of the first circular waveguide 20, even if a pressure difference between the inside and the outside of the first circular waveguide 20 occurs. An inner space surrounded by the first diaphragm 27 forms a first ring shaped protruding section 29. The first ring shaped protruding section 29 is in connection with the first circular pipe conduit 22. The first diaphragm 27 is preferably disposed in the vicinity (a position near the first rectangular waveguide 10 in an axial direction) of a joining portion of the first side wall section 23 and the first cylindrical section 21, in the first cylindrical section 21. Note that the first diaphragm 27 is not limited to a position near the first rectangular waveguide 10. In order to allow plastic deformation, the first diaphragm 27 is preferably configured such that the thickness of the first diaphragm 27 is thinner than the thickness of a portion excluding the first diaphragm 27 in the first circular waveguide 20.

The second diaphragm 47 is a plastically deformable section allowing a plastic deformation such that the length (length L in an axial direction of the second circular pipe conduit 42) in an axial direction (direction along the central axis 80) of the second circular waveguide 40 is changed. The second diaphragm 47 protrudes to the outer side in a radial direction of the second circular waveguide 40, the second diaphragm being disposed at a periphery of the second cylindrical section 41. The second diaphragm 47 is configured so as to maintain the length in the axial direction of the second circular waveguide 40, even if a pressure difference between the inside and the outside of the second circular waveguide 40 occurs. The inside space surrounded by the second diaphragm 47 forms a second ring shaped protruding section 49. The second ring shaped protruding section 49 is in connection with the second circular pipe conduit 42. The second diaphragm 47 is preferably disposed in the vicinity (a position near the second rectangular waveguide 50 in an axial direction) of a joining portion of the second side wall section 43 and the second cylindrical section 41, in the second cylindrical section 41. Note that the second diaphragm 47 is not limited to a position near the second rectangular waveguide 50. In order to allow plastic deformation, the second diaphragm 47 is preferably configured such that the thickness of the second diaphragm 47 is thinner than the thickness of a portion excluding the second diaphragm 47 in the first circular waveguide 20. If the inner wall face of the second side wall section 43 is moved by a shift amount S in an axial direction, the second diaphragm 47 can be set so that an edge of an outer side (the second rectangular waveguide 50 side) in an axial direction of the second diaphragm 47 moves by S. This point also applies for the first diaphragm 27.

The configuration and manufacturing method otherwise is similar to the first example embodiment.

According to the second example embodiment, similar to the first example embodiment, by providing diaphragms 27 and 47 in the circular waveguides 20 and 40, even if variations or the like in component dimensional accuracy, assembly accuracy or permittivity occur, since it is possible to obtain a desired band width by adjusting the diaphragms 27 and 47, there is no need for re-manufacturing, and this leads to a decrease in cost. Also, according to the second example embodiment, the embodiment is provided for a situation where there is no space on the rectangular waveguides 10 and 50 side, in the axial direction of the circular waveguides 20 and 40.

Examples 3 and 4

Figure 7A:
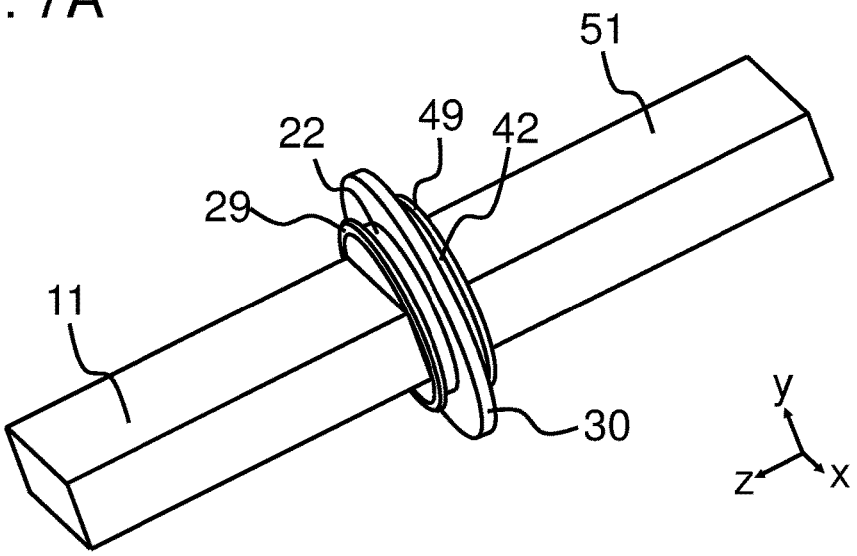
FIG. 7A is a perspective view schematically showing a configuration for an electromagnetic field analysis.
Figure 7B:
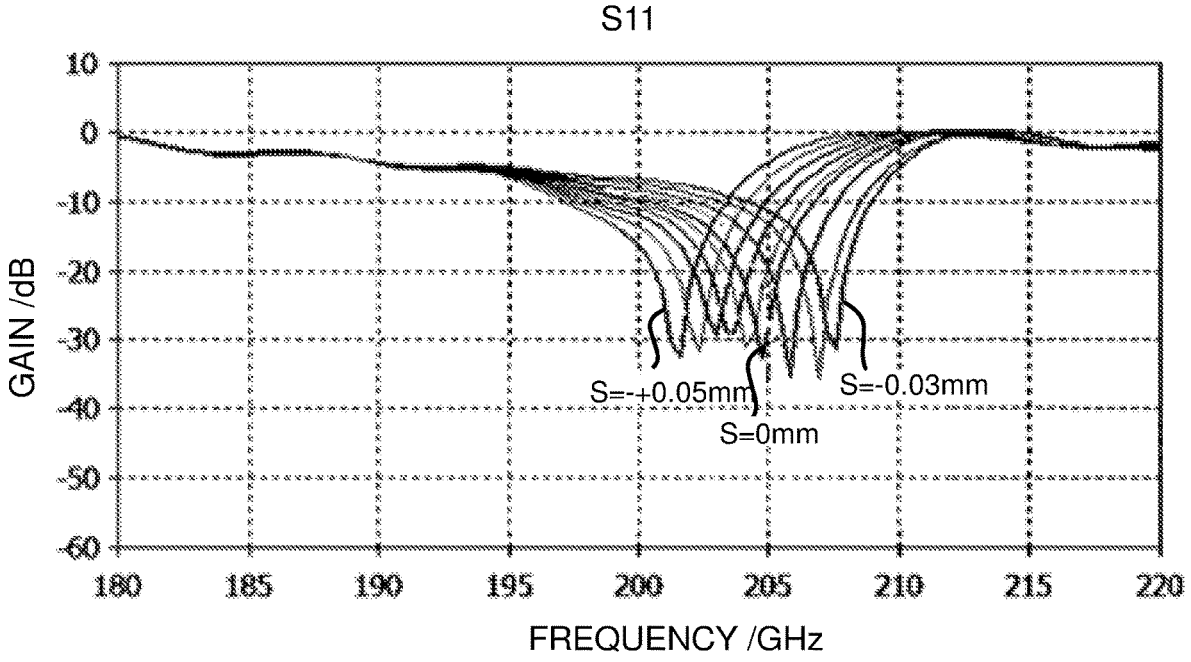
FIG. 7B is a graph showing relationships between gain value of S11 and shift amount S and frequency, of a high frequency window according to example 3.
Figure 8A:
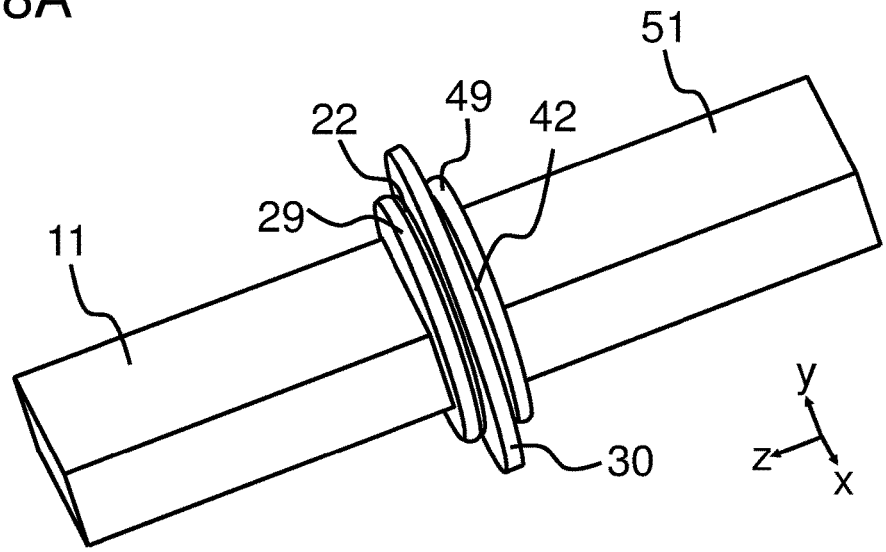
FIG. 8A is a perspective view schematically showing a configuration for an electromagnetic field analysis.
Figure 8B:
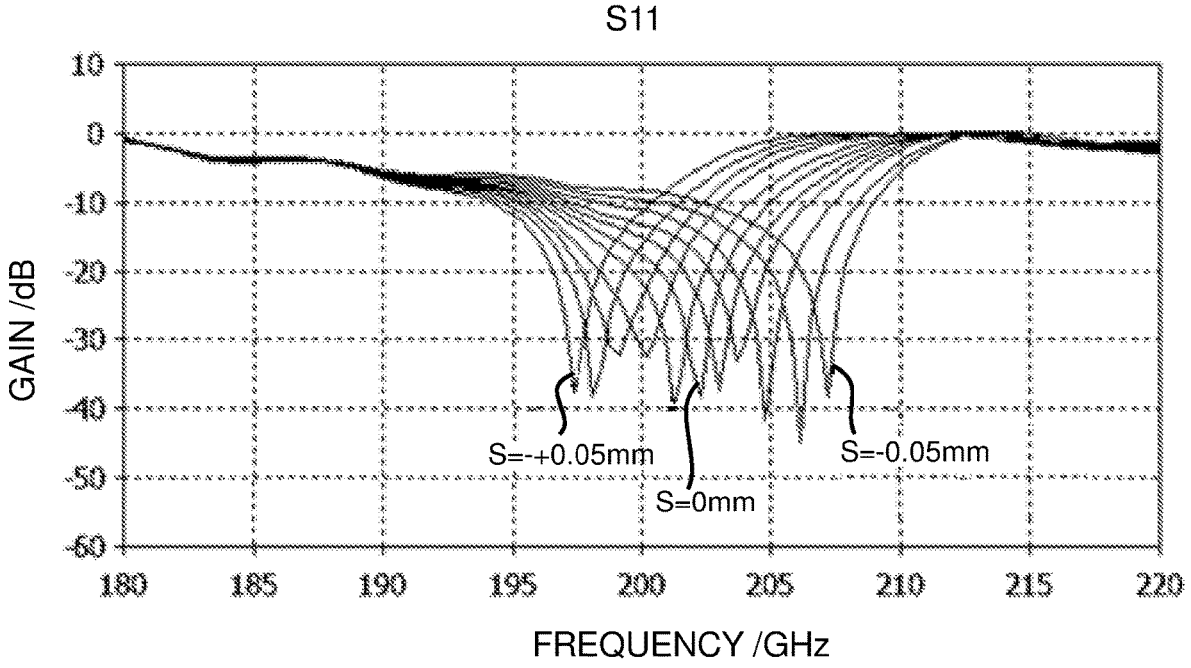
FIG. 8B is a graph showing relationships between S11 and shift amount S and frequency, of a high frequency window according to example 4.

A 3-dimensional electromagnetic field analysis of a high frequency window according to examples 3 and 4 will be explained with reference to the drawings. FIG. 7A is a perspective view schematically showing a configuration for use in performing an electromagnetic field analysis, and FIG. 7B is a graph showing relationships between S11 and shift amount S and frequency, of a high frequency window according to example 3. FIG. 8A is a perspective view schematically showing a configuration for use in performing an electromagnetic field analysis, and FIG. 8B is a graph showing relationships between S11 and shift amount S and frequency, of a high frequency window according to example 4.

Although the configuration of the high frequency window according to examples 3 and 4 is similar to the basic configuration of the high frequency window according to the second example embodiment (see FIG. 5 and FIGS. 6A-6C), the size (dimensions) of the first ring shaped protruding section 29 and the second ring shaped protruding section 49 differ, and the dimensions of other component sections (the first rectangular pipe conduit 11, the first circular pipe conduit 22, the dielectric plate 30, the second circular pipe conduit 42, and the second rectangular pipe conduit 51) are the same. It is to be noted that in FIG. 7A and FIG. 8A, wall faces (for example, metal such as Cu) of the waveguides (equivalent to 10, 20, 40 and 50 in FIG. 5) are omitted.

With regard to the dimensions of each of the component sections, the resonance frequency is set to be approximately 200 GHz. That is, the cross section dimensions of the first rectangular pipe conduit 11 are set to vertical dimension of 0.432 mm×horizontal dimension of 0.864 mm, the dimensions of the first circular pipe conduit 22 are set to diameter of 1 mm×thickness dimension of 0.085 mm to 0.185 mm (median value 0.135 mm), the dimensions of the dielectric plate 30 are set to diameter of 2 mm×thickness dimension of 0.1 mm, the dimensions of the second circular pipe conduit 42 are set to diameter of 1 mm×thickness dimension of 0.085 mm to 0.185 mm (median value 0.135 mm), and the cross section dimensions of the second rectangular pipe conduit 51 are set to vertical dimension of 0.432 mm×horizontal dimension of 0.864 mm. The dimensions of the first ring shaped protruding section 29 and the second ring shaped protruding section 49 in FIG. 7A are set to an external diameter of 1 mm, internal diameter of 0.95 mm, and cross section diameter of 0.05 mm. The dimensions of the first ring shaped protruding section 29 and the second ring shaped protruding section 49 in FIG. 8A are set to an external diameter of 1 mm, internal diameter of 0.9 mm, and cross section diameter of 0.1 mm (double the cross section diameter of the first ring shaped protruding section 29 and the second ring shaped protruding section 49 in FIG. 7A).

MICROWAVE-STUDIO manufactured by CST Company was used for 3-dimension electromagnetic field analysis of a high frequency window. A 3-dimension electromagnetic field analysis result of a high frequency window according to example 3 is as in FIG. 7B, and a 3-dimension electromagnetic field analysis result of a high frequency window according to example 4 is as in FIG. 8B. In FIG. 7B and FIG. 8B, the horizontal axis indicates frequency in GHz and the vertical axis indicates gain value of S11 (return loss in dB). It is to be noted that with respect to the first ring shaped protruding section 29 and the second ring shaped protruding section 49, similar to FIG. 5, calculation is performed assuming that in a case where the length in the axial direction of the first circular pipe conduit 22 and the second circular pipe conduit 42 (equivalent to L, L' in FIG. 5) is changed by a shift amount S in an axial direction, an edge section of an outer side in an axial direction of the first ring shaped protruding section 29 and the second ring shaped protruding section 49 will be changed by a change of S in an axial direction. It is to be noted that the shift amount S is changed by changing both the first circular pipe conduit and the second circular pipe conduit.

Referring to FIG. 7B, resonance frequency (frequency of a portion where gain is minimum in the graph) changes as the shift amount S changes in example 3. Although the change is not large with regard to S11, it is possible to select an optimum value based on the resonance frequency. FIG. 7B shows, e.g., shift amounts S=+0.05 mm, S=0 mm, and S=−0.03 mm.

Referring to FIG. 8B, it is understood that resonance frequency changes as the shift amount S changes in example 4. Although the change is not large with regard to S11, it is possible to select an optimum value based on the resonance frequency. Also, in example 4, although cross section diameters of the first ring shaped protruding section 29 and the second ring shaped protruding section 49 are doubled in comparison with example 3, a large difference in the resonance frequency trend does not occur, and it is understood that a discrepancy (or variation) in design value according to the size of the first ring shaped protruding section 29 and the size of the second ring shaped protruding section 49 is small, and design of the first ring shaped protruding section 29 and the second ring shaped protruding section 49 may not be rigorous. This point may be said to be a merit of the configuration of the second example embodiment. FIG. 8B shows, e.g., shift amounts S=+0.05 mm, S=0 mm, and S=−0.05 mm.

Third Example Embodiment

Figure 9:
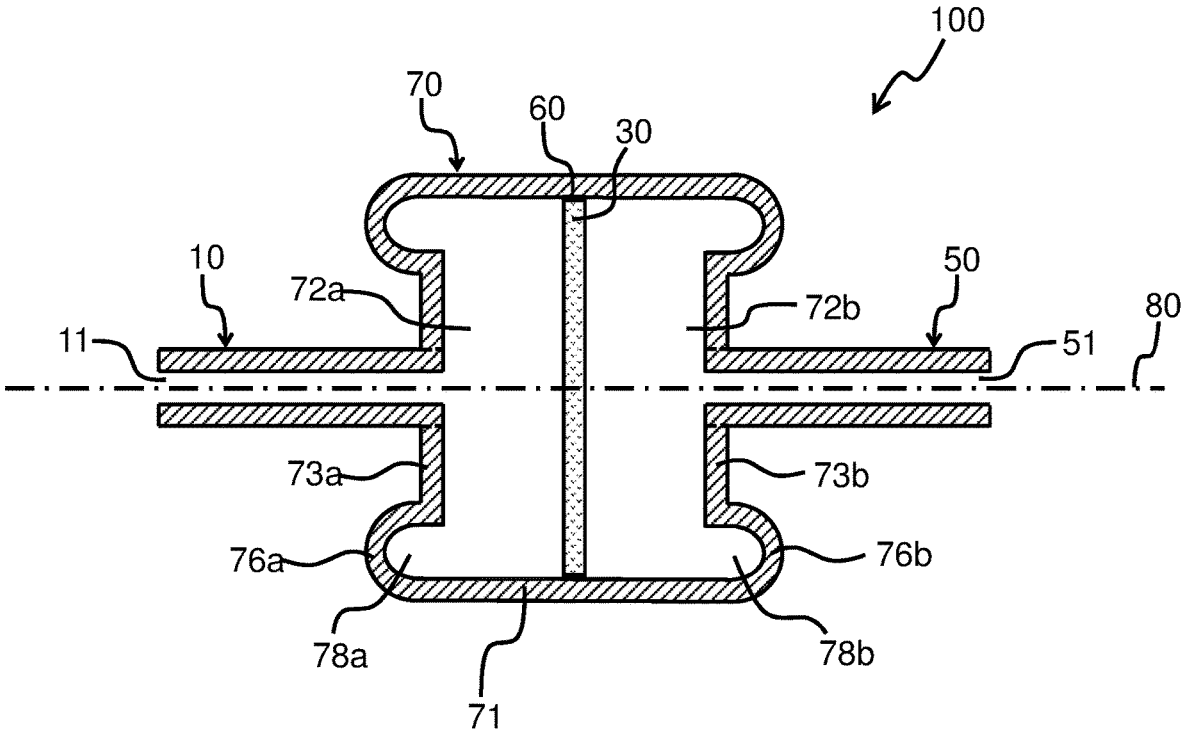
FIG. 9 is a cross section along an axial direction schematically showing a configuration of a high frequency window according to a third example embodiment.

A high frequency window according to a third example embodiment will be explained with reference to the drawings. FIG. 9 is a cross section along an axial direction schematically showing a configuration of the high frequency window according to the third example embodiment.

In the third example embodiment, being a modified example of the first example embodiment, a flange section (24 and 44 in FIG. 1) and a mounting section (25 in FIG. 1) are not provided, and the dielectric plate 30 is airtightly held via a joining section 60 at an inner peripheral face of a cylindrical section 71. Diaphragms 76*a* and 76*b* are formed in end wall sections 73*a* and 73*b*, similar to the first example embodiment. Ring shaped protruding sections 78*a*, 78*b* are formed as shown, e.g., in FIG. 9. The configuration otherwise is similar to the first example embodiment.

According to the third example embodiment, by providing diaphragms 76*a* and 76*b* in a circular waveguide 70, similar to the first example embodiment, even if variations or the like in component dimensional accuracy, assembly accuracy or permittivity occur, since it is possible to obtain a desired band width by adjusting the diaphragms 76*a* and 76*b*, there is no need for re-manufacturing leading to a decrease in cost. Also, according to the third example embodiment, it is possible to apply in a case where there is no space on the outer side in a radial direction of the circular waveguide 70.

Fourth Example Embodiment

Figure 10:
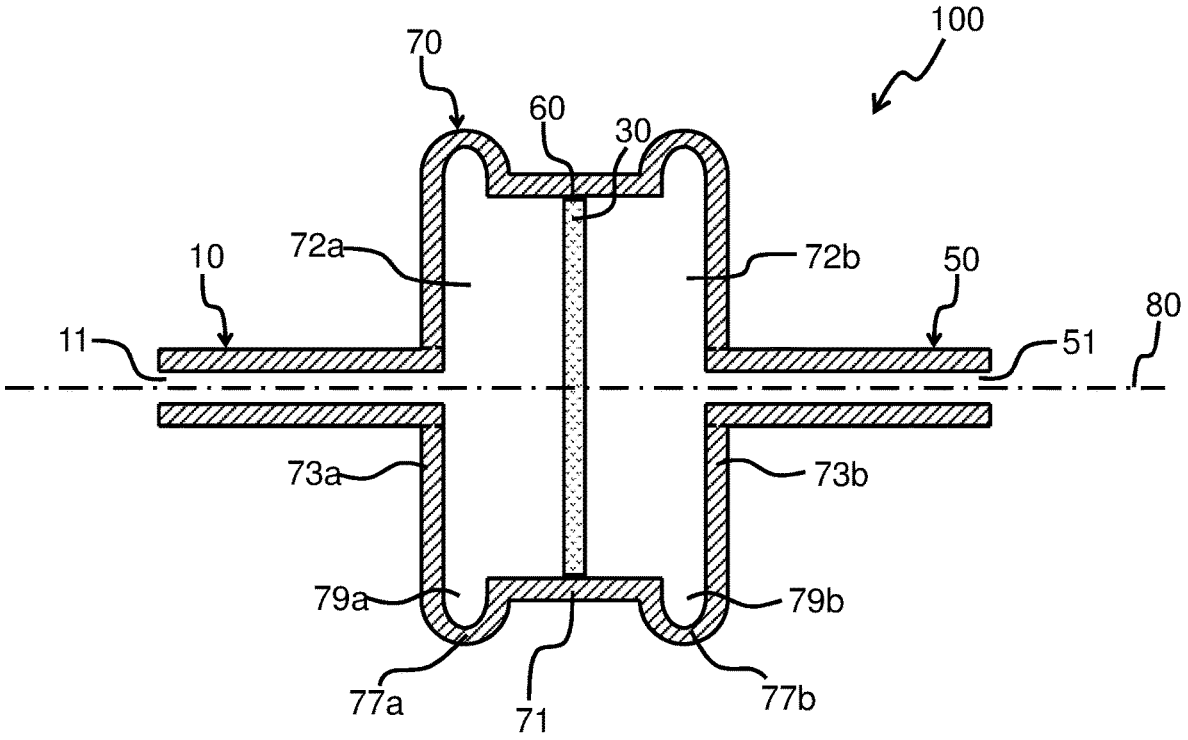
FIG. 10 is a cross section along an axial direction schematically showing a configuration of a high frequency window according to a fourth example embodiment.

A high frequency window according to a fourth example embodiment will be explained with reference to the drawings. FIG. 10 is a cross section along an axial direction schematically showing a configuration of the high frequency window according to the fourth example embodiment.

In the fourth example embodiment, being a modified example of the second example embodiment, a flange section (24 and 44 in FIG. 5) and a mounting section (25 in FIG. 5) are not provided, and the dielectric plate 30 is airtightly held via a joining section 60 at an inner peripheral face of a cylindrical section 71. Diaphragms 77*a* and 77*b* are formed at the cylindrical section 71, similar to the second example embodiment. Ring shaped protruding sections 79*a*, 79*b* are formed as shown, e.g., in FIG. 10. The configuration otherwise is similar to the second example embodiment.

According to the fourth example embodiment, by providing diaphragms 77*a* and 77*b* in the circular waveguide 70, similar to the second example embodiment, even if variations or the like in component dimensional accuracy, assembly accuracy or permittivity occur, since it is possible to obtain a desired band width by adjusting the diaphragms 77*a* and 77*b*, there is no need for re-manufacturing leading to a decrease in cost. Also, according to the fourth example embodiment, it is possible to apply in a case where there is no space on sides of rectangular waveguides 10 and 50, respectively sides in an axial direction of the circular waveguide 70.

Fifth Example Embodiment

Figure 11:
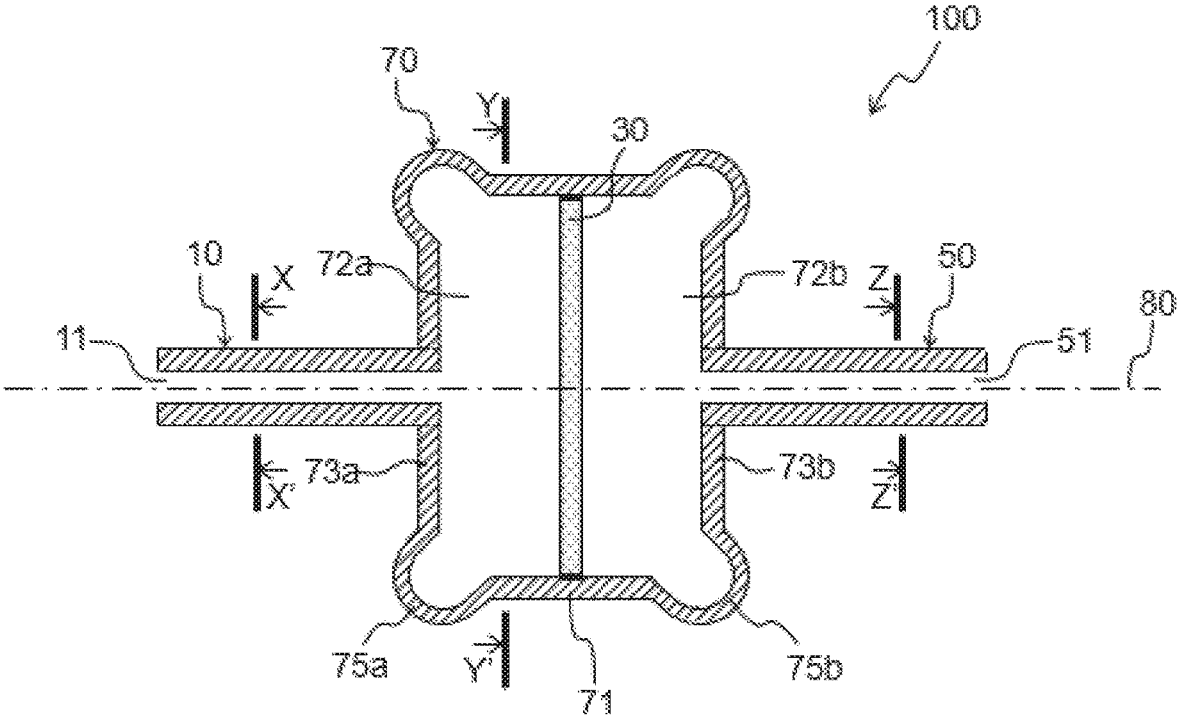
FIG. 11 is a cross section along an axial direction schematically showing a configuration of a high frequency window according to a fifth example embodiment.
Figure 12A:
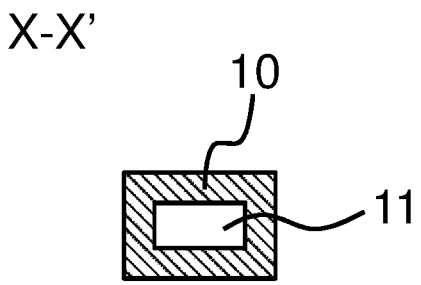
FIG. 12A is a cross section across X-X' of FIG. 11.
Figure 12B:
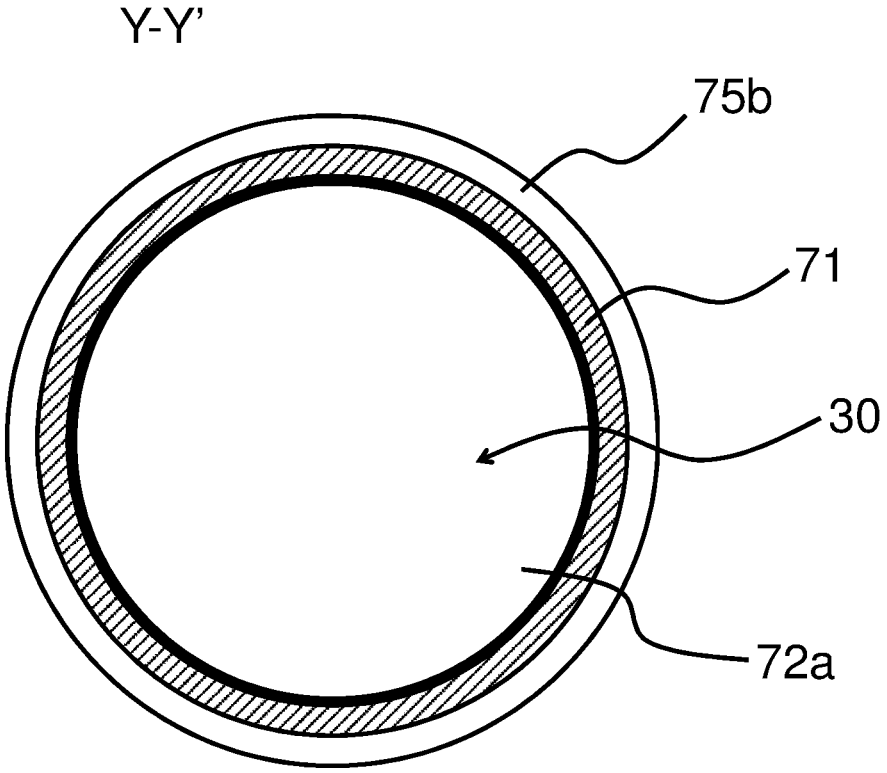
FIG. 12B is a cross section across Y-Y' of FIG. 11.
Figure 12C:
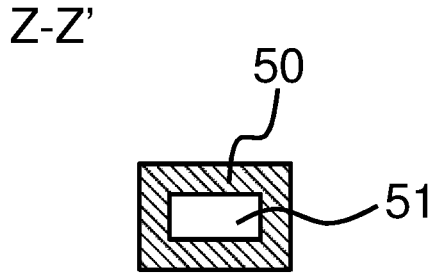
FIG. 12C is a cross section across Z-Z' of FIG. 11, schematically showing a configuration of the high frequency window according to the fifth example embodiment.

A high frequency window according to a fifth example embodiment will be explained with reference to the drawings. FIG. 11 is a cross section along an axial direction schematically showing a configuration of the high frequency window according to the fifth example embodiment. FIG. 12A is a cross section across X-X' of FIG. 11, FIG. 12B is a cross section across Y-Y' of FIG. 11, and FIG. 12C is a cross section across Z-Z' of FIG. 11, schematically showing a configuration of the high frequency window according to the fifth example embodiment.

As shown in FIG. 11, the high frequency window 100 comprises: a circular waveguide 70, a first rectangular waveguide 10, a second rectangular waveguide 50, and a dielectric plate 30.

The circular waveguide 70 is a tubular member that has a cylindrical section 71 having circular pipe conduits 72*a* and 72*b* with a circular shaped cross section, and end wall sections 73*a* and 73*b* on both sides in an axial direction (direction along central axis 80) of the cylindrical section 71. The circular waveguide 70 has plastically deformable sections 75*a* and 75*b* that allow plastic deformation such that the length in an axial direction (direction along central axis 80) of the circular waveguide 70 can be changed.

The first rectangular waveguide 10 is a tubular member having the first rectangular pipe conduit 11 with a cross section of a rectangular shape as shown in FIG. 12A, and is also joined to a side wall section 73*a* such that the first rectangular pipe conduit 11 is in communication to the circular pipe conduit 72*a*.

The second rectangular waveguide 50 is a tubular member having the second rectangular pipe conduit 51 with a cross section of rectangular shape as shown in FIG. 12C, and is also joined to the other side wall section 73*b* such that the second rectangular pipe conduit 51 is connected to the circular pipe conduit 72*b*.

The dielectric plate 30 is a member that is configured in a plate shape, that is disposed inside the circular pipe conduits 72*a* and 72*b*, and that is formed of a dielectric airtightly held to the cylindrical section 71.

The high frequency window 100 as described above, besides forming the plastically deformable sections 75*a* and 75*b* in the circular waveguide 70, may be assembled by a conventional method. Thereafter, pressures in a space (first rectangular pipe conduit 11, circular pipe conduit 72*a*) on the side of the first rectangular waveguide 10 and a space (second rectangular pipe conduit 51, circular pipe conduit 72*b*) on the side of the second rectangular waveguide 50, and an electromagnetic wave of a prescribed frequency transmitted to the first rectangular waveguide 10 from the second rectangular waveguide 50, are set to prescribed pressures respectively, and an electromagnetic wave of a prescribed frequency is transmitted from the second rectangular waveguide 50 to the first rectangular waveguide 10, a test is made as to whether or not a resonance frequency according to a design value is obtained. In a case where the resonance frequency according to the design value is not obtained, due to variations or the like in component dimensional accuracy, assembly accuracy or permittivity, length in the axial direction (direction along central axis 80) of the circular waveguide 70 is adjusted so that the value of S11 becomes minimum. Since the length in the axial direction of the circular waveguide 70 can be adjusted, the plastically deformable sections 75*a* and 75*b* are deformed.

According to the fifth example embodiment, by providing the plastically deformable sections 75*a* and 75*b* in the circular waveguide 70, even if a discrepancy from the design value occurs due to variation or the like in component dimensional accuracy, assembly accuracy or permittivity, since it is possible to adjust the length in an axial direction of the circular waveguide 70 by deforming the plastically deformable sections 75*a* and 75*b*, a manufacturing discrepancy can be corrected even after assembly.

<Supplementary Note>

The present invention enables a configuration of a high frequency window according to the first aspect.

In the high frequency window according to the first aspect, the plastically deformable section is configured so as to maintain the length in the axial direction of the circular waveguide, even if a pressure difference between the inside and the outside of the circular waveguide occurs.

In the high frequency window according to the first aspect, the plastically deformable section is a diaphragm that protrudes to the outer side in a radial direction of the circular waveguide ranging over the entire periphery in at least part of the cylindrical section.

In the high frequency window according to the first aspect, the diaphragm is arranged, with regard to the cylindrical section, in the vicinity of a joining portion of the cylindrical section and the side wall section.

In the high frequency window according to the first aspect, the plastically deformable section is a diaphragm that protrudes to the axially outer side of the circular waveguide ranging over the entire periphery in at least part of one or both of the end wall sections.

In the high frequency window according to the first aspect, the diaphragm is arranged, with regard to the side wall section, in the vicinity of a joining portion of the side wall section and the cylindrical section.

In the high frequency window according to the first aspect, the thickness of the diaphragm is thinner than the thickness of a portion excluding the diaphragm in the circular waveguide.

In the high frequency window according to the first aspect, the circular waveguide comprises: a first circular waveguide that has a first cylindrical section having a first circular pipe conduit with a circular shaped cross section, and a first end wall section on an outer end in an axial direction of the first cylindrical section; and a second circular waveguide that has a second cylindrical section having a second circular pipe conduit with a circular shaped cross section, and a second end wall section on an outer end in an axial direction of the second cylindrical section; wherein the dielectric plate is airtightly held to the first circular waveguide and the second circular waveguide by being sandwiched between the first cylindrical section and the second cylindrical section from both sides in an axial direction of the dielectric plate, the first circular pipe conduit and the second circular pipe conduit correspond to the circular pipe conduit, the first cylindrical section and the second cylindrical section correspond to the cylindrical section, and the first side wall section and the second side wall section correspond to the side wall section.

The high frequency window according to the first aspect, wherein: the first cylindrical section has a first flange section extending to an outer side in a radial direction of the first cylindrical section from an edge section on the second cylindrical section side, the second cylindrical section has a second flange section extending to an outer side in a radial direction of the second cylindrical section from an edge section on the first cylindrical section side, and the dielectric plate is airtightly held to the first circular waveguide and the second circular waveguide by being sandwiched between the first flange section and the second flange section from both sides in an axial direction of the dielectric plate.

In the high frequency window according to the first aspect, the first cylindrical section has a mounting section protruding to the second cylindrical section side ranging over the entire periphery from an outer periphery edge section of the first flange section, and the mounting section is mountable to an outer peripheral face of the second flange section.

In the high frequency window according to the first aspect, the mounting section restricts movement in a radial direction of the dielectric plate.

In the high frequency window according to the first aspect, the mounting section joins the second flange section and the dielectric plate via a joining section, and the dielectric plate joins the first flange section and the second flange section via a joining section.

In the high frequency window according to the first aspect, the dielectric plate joins with an inner peripheral face of the cylindrical section via a joining section.

In the high frequency window according to the first aspect, the joining section is either a metalized section, a welded section or brazed section.

The present invention enables a configuration of a manufacturing method of the high frequency window according to the second aspect.

It is to be noted that the various disclosures of the above mentioned Patent Literatures are hereby incorporated by reference into the present disclosure. Modifications and adjustments of example embodiments and examples may be made based on the entirety of the disclosure (including the scope of the claims and the drawings) of the present invention, and also based on fundamental technological concepts thereof. Also, various combinations and selections (or non-selection as necessary) of various disclosed elements (including respective elements of the respective claims, respective elements of the respective example embodiments and examples, respective elements of the respective drawings, and the like) are possible based on the entirety of the disclosure of the invention. That is, the present invention clearly includes every type of transformation and modification that a person skilled in the art can realize according to the entire disclosure including the claims and the drawings and to technological concepts thereof. In addition, with regard to numerical values and numerical band widths described in the present disclosure, arbitrary intermediate values, lower numerical values and smaller band widths should be interpreted to be described even if there is no clear description thereof.

REFERENCE SIGNS LIST

10 first rectangular waveguide
11 first rectangular pipe conduit
20 first circular waveguide
21 first cylindrical section
22 first circular pipe conduit
23 first side wall section
24 first flange section
25 mounting section
26, 27 first diaphragm (plastically deformable section)
28, 29 first ring shaped protruding section
30 dielectric plate
40 second circular waveguide
41 second cylindrical section
42 second circular pipe conduit
43 second side wall section
44 second flange section
46, 47 second diaphragm (plastically deformable section)
48, 49 second ring shaped protruding section
50 second rectangular waveguide
51 second rectangular pipe conduit
60 joining section
70 circular waveguide
71 cylindrical section
72*a*, 72*b* circular pipe conduit
73*a*, 73*b* side wall section
75*a*, 75*b* plastically deformable section
76*a*, 76*b*, 77*a*, 77*b* diaphragm (plastically deformable section)
78*a*, 78*b*, 79*a*, 79*b* ring shaped protruding section
80 central axis
100 high frequency window (RF window)

The invention claimed is:

1. A high frequency window, comprising:

a circular waveguide that has a cylindrical section having a circular pipe conduit with a circular shaped cross section, and end wall sections joined to both sides in an axial direction of the cylindrical section;

a first rectangular waveguide that has a first rectangular pipe conduit with a rectangular shaped cross section and that is joined to one of the end wall sections so that the first rectangular pipe conduit communicates with the circular pipe conduit;

a second rectangular waveguide that has a second rectangular pipe conduit with a rectangular shaped cross section and that is joined to the other of the end wall sections so that the second rectangular pipe conduit communicates with the circular pipe conduit; and a dielectric plate that is configured as a plate shape, is disposed in the circular pipe conduit, and is airtightly held to the cylindrical section; wherein the circular waveguide has a plastically deformable section that is plastically deformable so that a length in an axial direction of the circular waveguide can be changed, wherein the plastically deformable section comprises a diaphragm that protrudes to an outer side in the axial direction of the circular waveguide, the diaphragm being disposed at a periphery of a predetermined part of one or both of the end wall sections; and the axial direction of the circular waveguide is the same direction as the axial direction of the cylindrical section.

2. The high frequency window according to claim 1, wherein the plastically deformable section is configured to maintain the length in the axial direction of the circular waveguide after the length has been changed, even if a pressure inside the circular waveguide is different from a pressure outside the circular waveguide.

3. The high frequency window according to claim 1, wherein the plastically deformable section further comprises another diaphragm that protrudes to an outer side in a radial direction of the circular waveguide, the another diaphragm being disposed at the periphery of another predetermined part of the cylindrical section.

4. The high frequency window according to claim 3, wherein the another diaphragm is arranged between the cylindrical section and the end wall sections in the cylindrical section.

5. The high frequency window according to claim 3, wherein a thickness of the another diaphragm is thinner than a thickness of a portion of the circular waveguide excluding the another diaphragm.

6. The high frequency window according to claim 1, wherein the diaphragm is arranged between the end wall sections and the cylindrical section.

7. The high frequency window according to claim 1, wherein the dielectric plate is joined to an inner peripheral face of the cylindrical section via a joining section.

8. The high frequency window according to claim 1, wherein the circular waveguide comprises:

a first circular waveguide that has a first cylindrical section having a first circular pipe conduit with a circular shaped cross section, and a first end wall section on an outer side in an axial direction of the first cylindrical section; and a second circular waveguide that has a second cylindrical section having a second circular pipe conduit with a circular shaped cross section, and a second end wall section on an outer side in an axial direction of the second cylindrical section; wherein the dielectric plate is airtightly held to the first circular waveguide and the second circular waveguide by being sandwiched between the first cylindrical section and the second cylindrical section in an axial direction of the dielectric plate, the first circular pipe conduit and the second circular pipe conduit correspond to the circular pipe conduit, the first cylindrical section and the second cylindrical section correspond to the cylindrical section; and the end wall sections comprise the first end wall section and the second end wall section.

9. A manufacturing method for a high frequency window wherein a circular waveguide comprising a cylindrical section is joined between a first rectangular waveguide and a second rectangular waveguide, and a dielectric plate is held in the circular waveguide, the dielectric plate separating the circular waveguide into a space on a side of the first rectangular waveguide side and a space on a side of the second rectangular waveguide side, the high frequency window having a plastically deformable section that allows plastic deformation in at least an axial direction of the circular waveguide in the circular waveguide, the method comprising:

adjusting a length in the axial direction of the circular waveguide, such that, with the space on the side of the first rectangular waveguide side and the space on the side of the second rectangular waveguide side each having prescribed pressures, a gain value of S11 is minimum when an electromagnetic wave of a prescribed frequency is transmitted to the first rectangular waveguide from the second rectangular waveguide, wherein the plastically deformable section is plastically deformed when the length in the axial direction of the circular waveguide is adjusted; and the axial direction of the circular waveguide is the same direction as the axial direction of the cylindrical section.

* * * * *